US005464477A

United States Patent [19]

Awad

[11] Patent Number: 5,464,477

[45] Date of Patent: Nov. 7, 1995

[54] PROCESS FOR CLEANING AND DRYING FERROUS SURFACES WITHOUT CAUSING FLASH RUSTING

[75] Inventor: Sami B. Awad, Drexel Hill, Pa.

[73] Assignee: Crest Ultrasonics Corporation, Trenton, N.J.

[21] Appl. No.: 146,362

[22] Filed: Nov. 2, 1993

Related U.S. Application Data

[63] Continuation-in-part of Ser. No. 18,693, Feb. 17, 1993, Pat. No. 5,397,397, which is a continuation-in-part of Ser. No. 947,670, Sep. 18, 1992, abandoned.

[51] Int. Cl.[6] ..... B08B 3/08; B08B 3/12; C11D 7/24

[52] U.S. Cl. ..... 134/1; 134/2; 134/26; 134/29

[58] Field of Search ..... 134/26, 27, 28, 134/29, 1, 2

[56] References Cited

U.S. PATENT DOCUMENTS

| | | | |
|---|---|---|---|
| Re. 33,210 | 5/1990 | Stoufer | 252/153 |
| 3,030,238 | 4/1962 | Cohn | 134/26 |
| 3,630,929 | 12/1971 | Dijk | 252/136 |
| 4,156,619 | 5/1979 | Griesshammer | 134/2 |
| 4,595,527 | 6/1986 | Gipp | 252/546 |
| 4,683,008 | 7/1987 | Betts | 134/27 |
| 4,704,225 | 11/1987 | Stoufer | 252/153 |
| 4,787,941 | 11/1988 | LaPlaca | 134/25.4 |
| 4,818,427 | 4/1989 | Altenschoepfer et al. | 252/174.21 |
| 4,859,359 | 8/1989 | DeMatteo et al. | 252/174.15 |
| 4,877,556 | 10/1989 | Wilsberg et al. | 252/544 |
| 4,931,103 | 6/1990 | Atwater | 134/2 |
| 4,983,224 | 1/1991 | Mombrun et al. | 134/40 |
| 4,992,197 | 2/1991 | Huber | 252/148 |
| 5,011,620 | 4/1991 | Dishart et al. | 252/188 |
| 5,031,648 | 7/1991 | Lutner et al. | 134/32 |
| 5,041,235 | 8/1991 | Kilbarger | 252/170 |
| 5,112,358 | 5/1992 | Deal, III | 8/137 |
| 5,190,595 | 3/1993 | Ameen et al. | 134/40 |
| 5,296,040 | 3/1994 | Dybus et al. | 134/25.1 |

*Primary Examiner*—David A. Simmons
*Assistant Examiner*—Saeed T. Chaudhry
*Attorney, Agent, or Firm*—Limbach & Limbach

[57] ABSTRACT

The present invention relates to an aqueous composition and process useful for cleaning and drying ferrous surfaces. According to the invention, a water-immiscible hydrocarbon or non-halogenated organic solvent cleaning step is followed by an aqueous displacement solution (ADS) which contains a surfactant component and a pH modifier component in sufficient amounts to substantially displace the hydrophobic organic solvent residue from the surface of the substrate and prevent its redeposition. The ferrous metal surfaces are then rinsed with hot deionized ultrasonically agitated water which comprises one or more water soluble basic components. This aqueous composition is capable of protecting ferrous metal surfaces form flash rusting after aqueous cleaning or solvent treatments of the surfaces, and particularly during the deionized water rinsing and drying steps.

12 Claims, No Drawings

PROCESS FOR CLEANING AND DRYING FERROUS SURFACES WITHOUT CAUSING FLASH RUSTING

CROSS-REFERENCE TO RELATED APPLICATION

This is a continuation-in-part of a application, Ser. No. 08/018,693, filed on Feb. 17, 1993, U.S. Pat. No. 5,397,397, which is a continuation-in-part of an application, Ser. No. 07/947,670, filed on Sep. 18, 1992 now abandoned.

FIELD OF THE INVENTION

The present invention relates to an aqueous composition and improved process useful for ultrasonic cleaning and drying of various metallic and non-metallic surfaces or components. The present invention also relates to an aqueous composition and improved process capable of protecting ferrous metal surfaces from flash rusting after aqueous ultrasonic cleaning or solvent treatments of the surfaces and particularly during water rinsing and air drying. The improved process provides a viable alternative to replace the ozone-depleting chlorofluorocarbons, halogenated solvents and other volatile organic solvents (VOC) commonly used. The present invention provides an effective method for removal of various light and heavy surface contaminants such as fluxes, oils, waxes, buffing and lapping compounds, finger prints, silicone oils, metal forming lubricants, polymers and mold release compounds.

BACKGROUND OF THE INVENTION

In contrast to the ozone depleting solvents such as CFCs, and halogenated solvents, water immiscible petroleum, synthetic and/or natural terpene hydrocarbons or hydrocarbons modified with other additives or surfactants are increasingly used as alternative sources for the cleaning of metallic and non-metallic surfaces. However, these solvents are always accompanied with rinsing and drying problems. Briefly, solvents are difficult to be rinsed off the surfaces with plain water and consequently require prolonged drying times and relatively high temperatures. Drying off these solvents is associated with potential fire or environmental hazards, particularly those with low flash point solvents. Similar problems have also been found for surfaces cleaned with other water immiscible non-halogenated solvent cleaners including medium-high molecular weight alcohols, ethers, amines, esters and derivatives or mixtures.

Water rinsing of surfaces cleaned with these solvents is difficult because of their inherent lower surface tension. Furthermore, these non-halogenated solvents tend to leave a very thin organic film, after rinsing and drying, adsorbed on the surfaces which negatively interferes in many cases with the next step in a multi-step surface preparation such as etching, plating, painting or thin film coatings by vacuum deposition.

Several plain water ultrasonic and spray rinse steps, following a cleaning step with either water-immiscible or water-emulsifiable or dispersable hydrocarbon non-halogenated solvent cleaners at various temperatures, failed to completely remove the undesirable residue of the organic solvents in the relatively short time which is demanded by typical production requirements. The incomplete removal of the water-immiscible non-halogenated solvent film therefore renders many metallic and non-metallic surfaces, undesirably, water repellant or hydrophobic.

Subsequent processes such as etching, plating, coating, vacuum vapor deposition or painting require water break-free or hydrophilic and rust-free surfaces to produce good results. Otherwise, the surface may suffer, for example, differential etching or coat adhesion problems respectively. Furthermore, a partially hydrophobic surface tends to dewet the rinse water leaving water droplets on the surface (water brake) which may dry in place leaving residual marks on drying. Moreover, the unremoved residuals of hydrocarbons or non-halogenated solvent may contain some of the original surface contaminants. On the other hand, a water break-free surface drains the rinse water faster and requires less energy and time to dry.

For example, metallic and non-metallic substrates which were first treated with a water immiscible (or partially water emulsifiable), heated, hydrocarbon base or non-halogenated solvent concentrate, by immersion in ultrasonically cavitated bath or which were submerged sprayed or simply dipped in with vertical or horizontal oscillation or rotation followed by rinsing with water, or a water diluted emulsion of the same hydrocarbon or non-halogenated solvent, ultrasonically cavitated, or sprayed or submerged sprayed followed by similarly agitated multi water rinses, failed to produce surfaces which are entirely free from the hydrophobic solvent residues. These residues may produce an undesirable odor of the natural hydrocarbons (terpenes) or non-halogenated or petroleum hydrocarbon solvent or included additives; or may interfere with the next step in a manufacturing operation process as aforementioned. Furthermore, the residual hydrocarbon or non-halogenated solvent with low flash point may create a fire-hazard if enough accumulates in the drying step which commonly uses recycled heated air. Air or inert gas drying techniques of those solvents require expensive and complex safeguards against fire hazard and to minimize their vapor release to the environment.

Flash rusting of ferrous metals was less problematic on using the CFC's and halogenated solvents in their cleaning because of the absence of the water element which promotes the formation of surface iron oxides films. Substituting the non-aqueous CFC's or halogenated solvents for cleaning (vapor degreasing) with aqueous cleaning or treatment and hot deionized water rinsing created unacceptable severe flash rusting problems, particularly in the presence of ultrasonic agitation which is needed and required for precision cleaning processes. Furthermore, drying of wet surfaces with hot air intensified the problem. Flash rusting of components made with certain precision, cause catastrophic performance failures in mechanical components such as the auto and aviation fuel injectors, and miniature ball bearings in the disk drive industry. Also, for the precision tooling surfaces that to be modified for better performance and less wear, by coating their surfaces with a thin film of titanium or zirconium nitride, the presence of surface oxides can be detrimental and causes coating adhesion failures and results in changing unevenly the precision tolerances of the tools.

It is therefore highly desirable to provide an improved process and aqueous composition for the cleaning and drying of metallic and non-metallic surfaces which overcomes the above-noted problems resulting from the incomplete removal of the hydrocarbon or non-halogenated solvent. It is also highly desirable to provide other means for ultrasonic aqueous cleaning, ultrasonic deionized water rinsing and air drying of ferrous metal surfaces and components thereof which overcomes the above noted problems and prevents flash rusting during and throughout the entire process and also fulfills the requirements for subsequent treatment steps such as heat treat and thin film coatings deposition.

SUMMARY OF THE INVENTION

The above objective of producing hydrophilic surfaces is accomplished by a process and an aqueous displacement solution composition according to the invention in which a water-immiscible non-halogenated or hydrocarbon solvent cleaning step is followed by an aqueous displacement solution (ADS) which contains a surfactant component and a pH modifier component in sufficient amounts to substantially displace the hydrophobic hydrocarbon or non-halogenated organic solvent residue from the surface of the substrate and prevent its redeposition. The displacement of the hydrophobic hydrocarbon or non-halogenated organic solvent residue was found to be greatly enhanced by cavitating the ADS with an ultrasonic energy.

This hydrocarbon, or organic solvent, aqueous displacement step is followed by one or more water rinse steps, using air spray or submerged spray, oscillation, rotation, with or without ultrasonic energy cavitation where the aqueous displacement film is freely removed. A drying step follows in which the basic water film wetting the cleaned substrates are dried on using recycled heated air or other drying techniques such as infra-red or vacuum or combination.

The protection of aqueously ultrasonically cleaned ferrous metal surfaces from flash rusting during the hot deionized water ultrasonically agitated rinses and the air drying steps was accomplished by an improvement to the process, according to the invention, in which the ferrous metal surfaces after the aqueous cleaning or treatment step were rinsed with hot deionized ultrasonically agitated aqueous rinsing solution, which comprises one or more of a water soluble basic component added in sufficient amount to maintain a pH value of about 7.5 or higher. Methods of adding the basic component into water rinses may include, but is not limited to, using a gravity feed, a venturi system or an electrical chemical feeding pump.

The process of this invention may be used in cleaning of various ferrous and non-ferrous surfaces such as of metals and their alloys including, but not limited to, steel, aluminum, copper, titanium, beryllium, silver, gold, nickel, and non-metallic substrates including, but not limited to, glass, silicones and ceramics. Examples of ferrous metal surfaces successfully protected from flash rusting, in accordance with this invention, for the next heat treatment or vapor deposition step or for shelving are M2 high speed steel tooling, silicone core iron, ductile steel, 400 and 1000 series steels.

DESCRIPTION OF THE INVENTION

It is an objective of this invention to provide an improved process and aqueous displacement solution (ADS) composition for the cleaning and drying of metallic and non-metallic surfaces which overcomes the aforementioned problems resulting from the incomplete removal of the hydrocarbon or non-halogenated solvent or other water-immiscible non-halogenated organic cleaning solvents. It is another objective of this invention to diminish the potential fire-hazard or an explosion in the dryer, and reducing the drying time by effectively removing the non-halogenated organic solvent residues or other water-immiscible cleaning solvents. It is a further objective to minimize the drag-out or the carry-over of the hydrocarbon or non-halogenated solvent into the rinses which increases the efficiency and the lifetime of the rinse water closed loop purification systems, thus minimizing waste and preserving water. Also, it is a primary objective of this invention to provide protection for ferrous metal surfaces against flash rusting, following an ultrasonic aqueous cleaning or treatment step, particularly during the hot deionized ultrasonic water rinsing and the air drying steps.

The cleaning process, according to this invention, comprises displacing the hydrocarbon or the non-halogenated solvent residues on the surface with an acidic or neutral or alkaline aqueous displacement solution (ADS) comprising at least one surfactant added in sufficient amount in a separate step in the process before the deionized water rinsing. The surfactant(s) preferably has low emulsification power for the hydrocarbon solvent or other non-halogenated water immiscible organic solvents.

Other than in the operating examples, or where otherwise indicated, all numbers expressing quantities of ingredients or process conditions used herein are to be understood as modified in all instances by the term "about."

The aqueous displacing solution for use in accordance with this invention is preferably formulated so as to displace the water immiscible hydrocarbon solvent or the non-halogenated organic film on the metallic or non-metallic substrate with a water rinsable film, so that the substrate may be subsequently freely rinsed with water and dried off in a shorter time. The general formula for the ADS according to the present invention, expressed as percent by weight, comprises one or more surfactants in an amount of about 0.01 to about 50 percent by weight, preferably, 0.01–10%, more preferably 0.01 to 1%; and/or an ionic surfactant in an amount of about 0.01 to about 50 percent by weight of said composition, preferably 0.01 to 10%, more preferably 0.01 to 1%; and a pH modifier in an amount of about 0.00001 to about 10 percent by weight of said composition. However, it is understood that the general formula can be varied as expressed as percent by weight based on the purpose of usage.

Preferred surfactants for use in accordance with the present invention are nonionic surfactants and anionic surfactants with low emulsification power for hydrocarbons or other water immiscible non-halogenated solvents. Particularly preferred nonionic surfactants include alkyl, alkylaryl or aryl glucosides and their alkyloxylated glucoside derivatives and alkyloxylated fatty alcohols or ethers. The aqueous displacing component formulations may comprise other optional anionic, nonionic surfactants or other additives.

Examples are fatty esters, amines, diesters, amides, ethers and derivatives thereof with or without alkyloxylation and with or without termination.

Particularly preferred anionic surfactants include alkyl or alkylaryl or aryl (with or without alkyloxylation) sulfates and sulfonates and phosphate esters and fatty acid salts. Other anionic components surfactants such as phosphonate acid or esters and fatty acids, diacids and polyacids and salts and derivatives with or without alkyloxylation may be used as optional ingredients to modify the ADS of the invention.

Preferred anions for use to modify the pH in accordance with the present invention include hydroxides, carbonate, bicarbonate and phosphates of metals in group I & II elements. Other preferred cationic pH modifiers include ammonia and ammonium salts or water soluble primary, secondary or tertiary amines with or without alkyloxylation and with or without termination.

The preferred solvent aqueous displacing solution (ADS) in this invention comprises at least one anionic or one nonionic surfactant and at least one pH modifier and composed in sufficient amounts.

The pH modifier is intended for the purpose of enhancing the hydrophobe displacement on surface and is also for solvent phase separation. In addition, the pH modifier is important to bring the pH to the desired level so that no harm such as undesired surface etch is done to the substrate. Preferred acids for use to modify the pH in accordance with the present invention include mineral acids and organic acids or polyacids with low molecular weight. More preferred acids or their partially neutralized or ammonium salts include sulfuric acid, nitric acid, phosphoric acid, hydrofluoric acid, formic acid, acetic acid, gluconic acid, glycolic acid, oxalic acid, tartaric acid and citric acid.

The flash rust inhibitor for use with ferrous metal surfaces, in accordance with this invention, is added into one or more of the deionized water rinse step(s) that follows an aqueous cleaning step(s) or an aqueous displacement step(s) or a hydrocarbon or non-halogenated solvent step(s). The preferred general formula for an aqueous rinsing solution containing the flash rust inhibitor, expressed as percentage weight, comprises one or more of water soluble anionic or cationic pH modifier component or mixture of, with pH above 7, preferably 8–12 and more preferably 9–11 in total amount of about 0.00001–50% preferably 0.0001–10% and more preferred 0.001–5% by weight. Preferred cationic component(s) and derivatives thereof are low molecular weight primary, secondary and tertiary alkyl, arly, or alkyl aryl, cyclic or acyclic amines or amino derivatives with or without alkyloxylation and with or without termination. Preferred molecular weight between 31 and 5000, preferably between 31 and 2000. More preferred molecular weight is between 31 and 500. Optional pH modifiers to adjust the pH to the desired range may include organic fatty acids, organic phosphate esters and organic phosphonic acids with or without alkyloxylation and derivatives and mixtures thereof.

One main advantage of this invention is that it offers a viable effective means to replace the ozone depleting solvent cleaners. Among other advantages, this invention substantially reduces the drag-out or carry over of the hydrocarbon or non-halogenated solvents to the rinses, therefore, allows efficient and economic rinse-water recovery through closed-loop purification systems. Also, it diminishes the potential for a fire-hazard or an explosion as well as it reduces the drying time.

For example, the drying time of a non-halogenated hydrocarbon solvent with relatively low vapor pressure can be reduced from 3 hours to 30 minutes when ADS is used as compared to deionized water (See EXAMPLE 6). The typical drying time under the temperatures ranging from 180° to 225° F. is between 1 to 10 minutes depending on several variables.

Also, this invention provides the protection for valuable manufactured ferrous components from flash rusting without having negative impact on the subsequent operation(s).

The substrate surface is tested for the water immiscible solvent removal by examining the surface for complete wettability or for water-break free surface by immersing the substrate, after the final water rinse, in an ambient deionized water followed by pulling it up slowly and observing any fast dewetting or shrinking spot(s). The degree of wettability is then determined versus the total surface area of the substrate. The degree of wettability according to the present invention is equal to the percentage of the surface divided by the total surface area.

The present invention will be better understood and appreciated from the examples which follow, all of which are intended to be illustrative only and not meant to unduly limit the scope of the invention.

EXAMPLE 1

Table 1 summarizes the results obtained from cleaning various substrates (metallic and non-metallic) with different cleaning compositions according to this invention. Substrates were used after contaminating the surface with a thin film of about 2 mg/cm2 surface area of a mineral based machining oil. The oil (Amocut Tripur Cutting oil from Amoco, Chicago, Ill.) was spread evenly on the whole surface of the substrate.

Substrates:

1. Stainless steel (316-L) 2"×4" panels
2. Aluminum (6061) 2"×4" panels
3. Glass plates 4"×4"
4. Thin Ceramic plates 2"×4" (used for manufacturing electronic circuit boards)
5. Thin Silicone wafers 4"×4" (parts for manufacturing solar energy panels)

TABLE 1

| Substrate Wettability | Solvent Cleaner | ADS | /Wash /Time | % Wettability with agitation | % with U/S |
|---|---|---|---|---|---|
| I. | 1 | A | 60 | 5 | 80 |
| Stainless Steel | 1 | A1 | 60 | 90 | 100 |
| | 2 | B | 60 | 15 | 100 |
| | 3 | C | 60 | 70 | 100 |
| | 4 | D | 30 | 85 | 100 |
| | 5 | E | 30 | 70 | 100 |
| II. | 1 | A | 60 | 5 | 75 |
| Aluminum | 1 | A1 | 60 | 90 | 100 |
| | 2 | B | 45 | 25 | 95 |
| | 3 | C | 60 | 95 | 100 |
| | 4 | D | 30 | 30 | 100 |
| | 5 | E | 30 | 50 | 100 |
| III. | 1 | A | | 50 | 90 |
| Silicone Wafers | 1 | A1 | | 85 | 100 |
| | 2 | B | 45 | 90 | 100 |
| | 3 | C | 60 | 85 | 100 |
| | 4 | D | | 85 | 100 |
| | 5 | E | 45 | 75 | 100 |
| IV. | 1 | A | | 70 | 100 |
| Glass | 1 | A1 | | 85 | 100 |
| | 2 | B | 45 | 90 | 100 |
| | 3 | C | 60 | 25 | 100 |
| | 4 | D | 30 | 70 | 100 |
| | 5 | E | | 50 | 75 |
| V. | 1 | A | | 40 | 90 |
| Ceramic | 1 | A1 | | 60 | 100 |
| | 2 | B | 45 | 95 | 100 |
| | 3 | C | 60 | 90 | 100 |
| | 4 | D | | 90 | 100 |
| | 5 | E | | 80 | 100 |

1. Bioact ® EC-7R. An orange terpene hydrocarbon (Petroferm Inc., Fernandina Beach, FL).
2. THO-130. A hydrotreated light petroleum distillate (Sun Refining and Marketing Company, Philadelphia, PA).
3. Axarel ® 9100. A mixed aliphatic hydrocarbons and aliphatic esters (E. I. du Pont, Wilmington, DE).
4. Exxate ® 1000. Water immiscible C10 branched-chain synthetic ester (Exxon Chemical Americas, Houston, TX).
5. Actrel ® 4493-L. Aliphatic petroleum hydrocarbon (Exxon Chemical Americas, Houston, TX).

A: Nonylphenoxyethoxyethanol (1% by weight).

A1: Nonylphenoxyethoxyethanol (1% by weight) and potassium hydroxide (0.005% by weight), pH is about 9–11.

B: Chem Crest 165 (Crest Ultrasonics, Trenton, N.J.), a mixture of anionic surfactant, citric acid and ammonium citrate and formaldehyde condensate, pH is about 5–7.

C: Chem Crest 211 (Crest Ultrasonics, Trenton, N.J.), a mixture of anionic and nonionic surfactants, triethanolamine and sodium metasilicate, pH is about 10–12.

D: Composition: Ethal DA-9, nonionic surfactant (Ethox Chemicals, Greensborough, N.C.); Triton CG-110 a polyglucoside nonionic surfactant (Union Carbide, Danbury, CT) and sodium carbonate, pH is about 8–9.

E: Chem Crest 55 from Crest ultrasonics, a mixture of nonionic surfactant, glycol ether, amine salt and phosphoric acid, pH is about 1–5.

EXAMPLE 2

Table 2 below illustrates the removal of the solvent cleaner from on the substrates, prepared as described in example 1, when sprayed rinsed with deionized water, at 120° F. and when similarly rinsed in sonicated overflowing water, at 120° F., for 60 seconds.

TABLE 2

| Substrate | Solvent | % Wettability spray rinse | % Wettability sonicated rinse |
|---|---|---|---|
| I. Stainless Steel | 5 | 5 | 25 |
| II. | 1 | 5 | 70 |
| Aluminum | 5 | 15 | 75 |
| III. Silicone | 5 | 20 | 70 |
| IV. Glass | 5 | 5 | 20 |

EXAMPLE 3

The following example (Table 3) illustrates the improvement in the removal of solvent residues using this invention. The solvent used in this example is Axarel® 9100 (E. I. dupont, Wilmington, Del.). This solvent cleaner is composed of mixed aliphatic hydrocarbons, aliphatic esters. The substrates were used after contaminating the surface with a thin film of about 2 mg/cm2 surface area of a mineral oil based machining oil. The oil was spread evenly on the whole surface of the substrate. The substrates were immersed in a circulated Axarel liquid concentrate heated at 150° F. for 1 minute, rinsed with water for 10 seconds, immersed in agitated solution of an aqueous cleaner composition according to this invention heated at 140° F. for 45 seconds and then rinsed with water spray at 110° F. for 45 seconds.

TABLE 3

| Substrate | ADS* | % Wettability with no sonics | % Wettability with sonics |
|---|---|---|---|
| 1. Stainless | No | 25 | |
| Steel | Yes | 95 | 100 |
| 2. Silicon | No | 25 | |
| wafer | Yes | 95 | 100 |
| 3. Silicone | No | 5 | |
| | Yes | 95 | 100 |
| 4. Glass | No | 70 | |
| | Yes | 95 | 100 |
| 5. Aluminum | No | 10 | |
| | Yes | 70 | 100 |

*The aqueous cleaner is composed of sodium naphthalene sulfonate, citric acid, ammonia and potassium hydroxide. pH of the aqueous cleaning solution was about 6–8.

Substrates:

1. Stainless steel (316-L) 2" × 4" panels;
2. Thin Silicone wafers 4" × 4";
3. Glass plates 4" × 4";
4. Thin Ceramic plates 2" × 4";
5. Aluminum (6061) 2" × 4" panels.

EXAMPLE 4

The following industrially manufactured components were processed according to the invention. Each group of substrates were subjected to the process described below. In each case the substrates were examined for complete removal of the contaminants and for complete wettability.

1. Brass pin eyelets. Contaminant is starine wax soldering flux.

2. Cylindrical metal plated electronic capacitors of various sizes. Contaminants are machining mineral oil and welding RMA flux.

The parts were placed in a suitable stainless steel flat or electrically driven rotating basket and processed as follows:

(1). The parts were immersed in a 10"×14"×10" ultrasonic stainless steel tank (Manufacturer: Crest Ultrasonics, Trenton, N.J.) filled with Axarel® 32 solvent cleaner (E. I. du Pont, Wilmington, Del.), at 160°–170° F., for 5–10 minutes. This solvent cleaner is composed of mixed aliphatic hydrocarbons, aliphatic esters and non-ionic surfactants. The ultrasonic bath transducers were powered by a Genesis SA generator at 90 watts/gallon and sweep frequency of 38–42 KHz.

(2). The parts were allowed to drain the excess hydrocarbon solvent for 30 seconds and then immersed in another similar 10"×14"×10" ultrasonic tank charged with Chem Crest 103, a mild alkaline solution (Crest Ultrasonics, Trenton, N.J.; pH=8–9.5, a mixture of nonylphenoxyethoxyethanol, coconut diethanolamide/diethanolamine and hexylene glycol), at 4% concentration and heated at 140°–150° F. for 5 minutes. The ultrasonic transducers were powered by a Genesis generator at 90 watts/gallon and sweep frequency of 39–41 KHz.

(3). The parts were allowed to drain the aqueous cleaner for 30 seconds and then sprayed with deionized water then immersed in another similarly ultrasonically powered tank charged with overflowing deionized water at a rate of 1 gallon/minute and heated at 100°–110° F. for 2 minutes.

(4). The parts were allowed to drain for 30 seconds and then immersed in another similar ultrasonically powered overflowing tank charge with deionized water which was heated at 100°–110° F. for w minutes. The parts exit between deionized water spraying headers and were then allowed to drain for 30 seconds.

(5). The parts were exposed to air blowoff knives for 15 seconds before immersion in a circulated hot air dryer heated at 190°–210° F. Sample of the parts were examined for wettability after step number 4 by fully immersion in a deionized water and were found fully wettable. The parts were examined for unremoved flux under long wave ultraviolet light or visually under a stereo microscope at 10–45 magnification and were found free from any residues. It was noted that the Axarel 32 phase separated and one the surface of the aqueous displacement solution in step (2), where it was moved into a separation tank or a decanter.

EXAMPLE 5

The following industrially manufactured components were processed according to the invention. Each group of substrates were subjected to the process described below. In each case the substrates were examined for complete removal of the contaminants and for complete wettability.

1. Ingot 10"×4"×5" of machined silicone wafers. Surface contaminants are SAE 30 mineral oil, silicone particles and silicone carbide.

2. Titanium and steel impellers 7" and 10" diameter. Contaminant is thick green wax (Rigidax) compound.

3. Stainless steel and brass pin points. Contaminant is heavy cutting mineral oil product.

The parts were placed in a suitable stainless steel flat or electrically driven rotating basket and processed as follows:

(1). The parts were immersed in a 10"×14"×10" stainless steel tank with two parallel spray headers installed close to the bottom of the tank and powered by a chemically resistant pump (Manufacturer: Crest Ultrasonics, Trenton, N.J.). The tank was filled with Axarel 9100 solvent cleaner (From E. I. du Pont, Wilmington, Del.) and heated at 165°–175° F. The parts were then subjected to the submerged spray for 5–10 minutes.

(2). The parts were allowed to drain the excess hydrocarbon solvent for 30 seconds and then immersed in another similar 10"×14"×10" ultrasonic tank charged with Chem Crest 103, a mild alkaline cleaner or Chem Crest 211 alkaline cleaner (from Crest Ultrasonics, Trenton, N.J.), at 5 % concentration and heated at 140°–150° F. for 5–10 minutes. The ultrasonic transducers were powered by a Genesis generator at 90 watts/gallon and sweep frequency of 39–41 KHz.

(3). The parts were allowed to drain the aqueous cleaner for 30 seconds and then sprayed with deionized water than immersed in another similar ultrasonically powered tank charged with overflowing deionized water at a rate of 1 gallon/minute and heated at 100°–110° F. for 2 minutes.

(4). The parts were allowed to drain for 30 seconds and then immersed in another similar ultrasonically powered overflowing tank charged with deionized water which was heated at 100°–110° F. for 2 minutes. The parts exit between deionized water spraying headers and were then allowed to drain for 30 seconds.

(5). The parts were exposed to air blowoff knives for 15 seconds before immersion in a circulated hot air dryer heated at 190°–210° F. Sample of the parts were examined for wettability after step number 4 by fully immersion in a deionized water and were found fully wettable. The parts were examined for unremoved oil contaminants under long wave ultraviolet light or visually under a stereo microscope at 10–45×magnification or by the clean cloth wipe test were found free from any residues. It was noted that the Axarel 9100 phase separated on the surface of the aqueous cleaner in step 2, where it was removed into a separation tank or a decanter. Using a circulating pump connected to the tank where the return solution is pumped close to the solution at slow rate, the floating hydrocarbon solvent was sparged out to a decanter. The solution was allowed to phase separate and the aqueous cleaner solution was returned to tank 2. The hydrocarbon solvent is optionally returned to tank 1 or collected and distilled under vacuum for reuse or collected for proper waste disposal.

EXAMPLE 6

The following industrially manufactured components were processed according to the invention. Each group of substrates were subjected to the process described below. In each case the substrates were examined for complete removal of the contaminants and for complete wettability.

1. Chrome plated steel piston rings. Contaminants are mineral oil, lapping compound, silicone carbide.

2. Semicircular flat galvanized steel wires of various diameters. Contaminant is a highly viscous sulfurized heat treat oil.

The parts were placed in a suitable stainless steel fixture and processed as follows:

(1). The parts were immersed in a 10"×14"×10" ultrasonic stainless steel tank (Manufacturer: Crest Ultrasonics, Trenton, N.J.). The ultrasonic bath transducers were powered by a Genesis® SA generator at 90 watts/gallon and sweep frequency of 38–42 KHz (Manufacturer: Crest Ultrasonics, Trenton, N.J.). The tank is also fitted with a deeply seated spray headers connected to a chemically resistant circulating pump to spray the solvent under its surface. The rank was filled with Axarel® 9100 solvent cleaner (From E. I. du Pont, Wilmington, Del.), at 150°–160° F. The parts were first submerged sprayed for 3 minutes and then turned off and the sonics were turned on for 2 minutes then the sequence was repeated one more time.

(2). The parts were allowed to drain the excess hydrocarbon solvent for 30 seconds and then immersed in another similar 10"×14"×10" ultrasonic tank charged with Chem Crest 211 (From Crest Ultrasonics, Trenton, N.J.), at 5% concentration and heated at 140°–150° F. for 5–10 minutes. The ultrasonic transducers were powered by a Genesis® generator at 90 watts/gallon and sweep frequency of 39–41 KHz.

(3). The parts were allowed to drain the aqueous cleaner for 30 seconds and then sprayed with deionized water than immersed in another similar ultrasonically powered tank charged with overflowing deionized water at a rate of 1 gallon/minute and heated at 100°–110° F. for 2 minutes.

(4). The parts were allowed to drain for 30 seconds and then immersed in another similar ultrasonically powered overflowing tank charged with deionized water which was heated at 100°–110° F. for 2 minutes. The parts exit between deionized water spraying headers and were then allowed to drain for 30 seconds.

(5). The parts were exposed to air knives for 15 seconds before immersion in a circulated hot air dryer heated at 190°–210° F.

Sample of the parts were examined for wettability after step number 4 by fully immersion in a deionized water and were found fully wettable. The parts were examined for unremoved oils under long wave ultraviolet light or examined visually under the microscope at 10–45× or by the clean wipe cloth test and were found free from any residues. It was noted that the Axarel® 9100 separated on the surface of the aqueous displacement solution step (2), where it was removed into a separation tank or a decanter.

EXAMPLE 7

This example illustrates the improvement in drying time according to this invention. Telecommunication exposed cable end wires filled with extended thermoplastic rubber gel modified with olefinic polymers were processed according to this invention as follows.

A cable end was placed in a suitable stainless steel fixture and processed as follows. Material of construction limited the maximum temperature to 135° F.

Process A:

1. The cable end wires were immersed in a 12"×18"×12" stainless steel tank (Manufacturer: Crest Ultrasonics, Trenton, N.J.). The tank is fitted with a deeply seated spray headers connected to a chemically resistant circulating pump to spray the solvent under its surface. The tank was filled with Axarel® 9100 solvent cleaner (From E. I. du Pont, Wilmington, Del.), at 150°–160° F. The parts were submerged sprayed for 10 minutes at 130° F. with vertical oscillation.

2. The cable end wires were allowed to drain the excess hydrocarbon solvent for 3 minutes and then immersed in another similar 12"×18"×12" ultrasonically activated tank charged with Chem Crest 211 (From Crest Ultrasonics, Trenton, N.J.), at 5% concentration heated at 135° F. for 5 minutes. The ultrasonic transducers were powered by a Genesis generator at 90 watts/gallon and sweep frequency of 39–41 KHz.

3. Step 2 was repeated in another similar tank under the same set of conditions.

4. The cable end wires were allowed to drain the aqueous cleaner for 1 minute and then sprayed with deionized water then immersed in another similar ultrasonically powered tank charged with overflowing deionized water at a rate of 1 gallon/minute and heated at 135° F. for 3 minutes 5. The cable end wires were subjected to deionized water air spray for 2 minutes and then allowed to drain for 30 seconds.

6. The cable was immersed in a circulated hot air dryer heated at 135° F. for 30 minutes.

Process B:

1. A cable end was immersed in a 12"×18"×12" stainless steel tank (Manufacturer: Crest Ultrasonics, Trenton, N.J.). The tank is fitted with a deeply seated spray headers connected to a chemically resistant circulating pump to spray the solvent under its surface. The tank was-filled with Axarel® 9100 solvent cleaner (From: E. I. du Pont, Wilmington, Del.), at 150°–160° F. The parts were submerged sprayed for 10 minutes at 130° F with vertical oscillation.

2. The cable was allowed to drain for 3 minutes and then immersed in a circulated air dryer heated at 135° F. for 3 hours.

Process C:

1. A cable end was immersed in a 12"×18"×12" stainless steel tank (Manufacturer: Crest Ultrasonics, Trenton, N.J.). The tank is fitted with a deeply seated spray headers connected to a chemically resistant circulating pump to spray the solvent under its surface. The tank was filled with Axarel® 9100 solvent cleaner (From: E. I. du Pont, Wilmington, Del.), at 150°–160° F. The parts were submerged sprayed for 10 minutes at 130° F. with vertical oscillation.

2. The cable was allowed to drain and air dry under the hood for 48 hours.

Each processed cable end wires was examined visually and by wiping the wires with a clean cloth for dryness and residual gel. The wires of the cable end according to process A was completely clean and dry. Residual Axarel solvent was detected on both of the cable wires cleaned according to processes B and C.

EXAMPLES 8–11

These examples illustrate the improvements achieved in protecting the ferrous components against surface flash rusting.

EXAMPLE 8

A group of 1018 steel rotor and shaft assemblies contaminated with soldering flux and heavy oil residues were subjected to the following two processes. Process A is a comparative example.

Process A:

1. The steel parts were placed in a stainless steel basket and then immersed in an ultrasonic 10"×14"×10" tank powered with an ultrasonic generator at frequency of 39–41 KHz and at about 90 watts/gallon of solution (manufacturer: Crest Ultrasonics, Trenton, N.J.), filled with Axarel 9100, a hydrocarbon based solvent cleaner from E. I. du Pont, heated at 160° F. for 5 minutes.

2. The parts were allowed to drain the excess hydrocarbon solvent for 30 seconds and then immersed in another similar ultrasonically powered tank charged with an aqueous basic ADS, pH about 11.3, at about 5% by volume concentration and at 145°–150° F. for 5–10 minutes.

3. The parts were allowed to drain the ADS solution for 30 seconds and then immersed in a another similar ultrasonically powered tank charged with overflowing deionized water at a rate of 1.5 gallons/minute and heated at 135° F. for 5 minutes.

4. The parts were allowed to drain for 30 seconds and then immersed in a another similar ultrasonically powered tank charged with overflowing deionized water at a rate of 1.5 gallons/minute and heated at 135° F. for 5 minutes.

5. The parts were immersed in a HEPA filtered circulated forced hot air dryer at 190°–200° F.

Sample of the parts were inspected under 10×magnification and it was found that the flux residues were completely absent. However, a film of surface rust, in the form of a brownish film or spots of different color intensities,, was evidenced on the surface of the parts. Also, it was visually observed that the light brownish film was formed during the rinse steps and greatly intensified during the drying step.

Process B:

1. The steel parts were placed in a stainless steel basket and then immersed in an ultrasonic 10"×14"×10" tank powered with an ultrasonic generator at frequency of 39–41 KHz and at about 90 watts/gallon of solution (manufacturer: Crest Ultrasonics, Trenton, N.J.), filled with Axarel® 9100, a hydrocarbon based solvent cleaner from E. I. du Pont, heated at 160° F. for 5 minutes.

2. The parts were allowed to drain the excess hydrocarbon solvent for 30 seconds and then immersed in another similar ultrasonically powered tank charged with Chem Crest 211 (an aqueous ADS solution) at about 5% concentration and at 145°–150° F. for 5–10 minutes.

3. The parts were allowed to drain the ADS solution for 30 seconds and then immersed in another similar ultrasonically powered tank charged with overflowing deionized water, modified by Chem Crest 77 (a basic aqueous solution containing 2-aminoethanol with pH 10–11.5 from Crest Ultrasonics, Trenton, N.J.), at a rate of 1.5 gallons/minute and heated at 135° F. for 5 minutes. The Chem Crest 77 was added and then injected into the tank initially at 2.5 by volume and then in small increments so as to maintain a pH of 10.5.

4. The parts were allowed to drain for 30 seconds and then immersed in a another similar ultrasonically powered tank charged with overflowing deionized water, modified by Chem Crest 77 at a rate of 1.5 gallons/minute and heated at 135° F. for 5 minutes. The Chem Crest 77 was added and then injected into the tank initially at 2.5% by volume and then in small increments so as to maintain a pH of 10.5.

5. The parts were immersed in a HEPA filtered circulated forced hot air dryer at 190°–200° F.

Sample of the parts were inspected under 10×magnification and it was found that the flux residues were completely absent. No surface rust in the form of brown film or spots on the surface was observed. The parts maintained their original color integrity throughout the water rinsing steps and the hot air drying step.

Process C:

1. The steel parts were placed in a stainless steel basket and then immersed in an ultrasonic 10"×14"×10" tank powered with an ultrasonic generator at frequency of 39–41

KHz and at about 90 watts/gallon of solution (manufacturer: Crest Ultrasonics, Trenton, N.J.), filled with Axarel® 9100, a hydrocarbon based solvent cleaner from E. I. DuPont, heated at 160° F. for 5 minutes.

2. The parts were allowed to drain the excess hydrocarbon solvent for 30 seconds and then immersed in another similar ultrasonically powered tank charged with Chem Crest 211 at about 5% concentration and at 145°–150° F. for 5–10 minutes.

3. The parts were allowed to drain the ADS solution for 30 seconds and then immersed in a another similar ultrasonically powered tank charged with overflowing deionized water, modified by Chem Crest 77C (a basic aqueous solution containing neutralized C6–$C_{30}$ fatty acids mixture, 2-aminoethanol, ethoxylated alkyl phosphate ester and ethoxylated alkyl amine guanidine complex and N-2-hydroxyethyl-2-aminoethanol from Crest Ultrasonics, Trenton, N.J.), at a rate of 1.5 gallons/minute and heated at 135° F. for 5 minutes. The Chem Crest 77C was added and then injected into the tank initially at 1.5% by volume and then in small increments so as to maintain a pH of about 9.

4. The parts were allowed to drain for 30 seconds and then immersed in a another similar ultrasonically powered tank charged with overflowing deionized water, modified by Chem Crest 77C, at a rate of 1.5 gallons/minute and heated at 135° F. for 5 minutes. The Chem Crest 77C was added and then injected into the tank initially at 1.5% by volume and then in small increments so as to maintain a pH of about 9.

5. The parts were immersed in a HEPA filtered circulated forced hot air dryer at 190°–200° F.

Sample of the parts were inspected under 10×magnification and it was found that the flux residues were completely absent. No surface rust in the form of brown film or spots on the surface was observed. The parts maintained their clean integrity throughout the water rinsing steps and the hot air drying step.

EXAMPLE 9

A group of various carbon tooling steel (high speed steel) and carbide inserts, which they were to be coated after the cleaning and rinsing and drying with titanium nitride film afterward using the vacuum vapor deposition technique, were subjected to the following process:

1. The parts were placed in a stainless steel basket and then immersed in an ultrasonic 10"×14"×10" tank powered with an ultrasonic generator at frequency of 39–41 KHz and at about 90 watts/gallon of solution (manufacturer: Crest Ultrasonics, Trenton, N.J.), filled with Axarel® 9100, a hydrocarbon based solvent cleaner from E. I. du Pont, heated at 170° F. for 5 minutes.
2. The parts were allowed to drain the excess hydrocarbon solvent for 30 seconds and then immersed in another similar ultrasonically powered tank charged with Chem Crest 270 solution, (an aqueous basic ADS solution), at about 8% by volume concentration and at 165° F. for 5–10 minutes.
3. The parts were allowed to drain the ADS solution for 30 seconds and then immersed in a another similar ultrasonically powered tank charged with overflowing deionized water, modified by Chem Crest 77C (from Crest Ultrasonics, Trenton, N.J.), at a rate of 1.5 gallons/minute and heated at 135° F. for 5 minutes. The Chem Crest 77C was added and then injected into the tank initially at 1.5% by volume and then in small increments so as to maintain a pH of about 9.
4. The parts were allowed to drain for 30 seconds and then immersed in another similar ultrasonically powered tank charged with overflowing deionized water, modified by Chem Crest 77C, at a rate of 1.5 gallons/minute and heated at 135° F. for 5 minutes. The Chem Crest 77C was added and then injected into the tank initially at 1.5% by volume and then in small increments so as to maintain a pH of about 9. The parts were briefly sprayed with deionized water for 15 seconds.
5. The parts were immersed in a HEPA filtered circulated forced hot air dryer at 190°–200° F.

Sample of the parts were inspected under 10×magnification and it was found that the oils, finger prints and some oxides were completely absent. No surface rust in the form of brown film or spots on the surface was observed. The parts maintained their clean integrity throughout the water rinsing steps and the hot air drying step. The parts were vacuum coated with titanium nitride. No adhesion failures were observed.

EXAMPLE 10

Another group of parts as in example 9 were subjected to all same steps except substituting the injected basic material with Chem Crest 77 (a basic aqueous solution with pH of about 10–11.5, from Crest Ultrasonics, Trenton, N.J.) and was used at concentration of 2%. The cleaned parts did not show any signs of flash rusting and vacuum coating the parts with titanium nitride did not show any adhesion problems.

EXAMPLE 11

A group of automotive needles armatures, needles and core seats of 440 and silicone iron steels, contaminated with light machine oils and metal fines, were subjected to the following process without experiencing any flash rusting. No hydrocarbon solvent was used in the first step. It was observed that in an exact comparative experiment without having and maintaining the flash rust aqueous preventive solution in the rinses the parts developed the brown iron oxide film on their surfaces during the water rinse step and predominantly during the drying step.

1. The parts were placed in an electrically driven rotating cylindrical stainless steel basket and then immersed in an ultrasonic 10"×14"×10" tank powered with an ultrasonic generator at frequency of 39–41 KHz and at about 90 watts/gallon of solution (manufacturer: Crest Ultrasonics, Trenton, N.J.), filled with Chem Crest 270 solution at 6%, 160° F. and for 4 minutes.

2. The parts were allowed to drain the alkaline solution for 30 seconds and then immersed in another similar ultrasonically powered tank charged with overflowing deionized water, modified by Chem Crest 77E, a basic aqueous solution composed of 2-aminoethanol and potassium hydroxide with pH 10–11.5 (from Crest Ultrasonics, Trenton, N.J.), at a rate of 1.5 gallons/minute and heated at 135° F. for 5 minutes. The Chem Crest 77E was added and then injected into the tank initially at 1.5% by volume and then in small increments so as to maintain a pH of about 11.

3. The parts were allowed to drain for 30 seconds and then immersed in a another similar ultrasonically powered tank charged with overflowing deionized water, modified by Chem Crest 77E, at a rate of 1.5 gallons/minute and heated at 135° F. for 5 minutes. The Chem Crest 77E was added and then injected into the tank initially at 1.5% by volume and then in small increments so as to maintain a pH of about 11.

What is claimed is:

1. A process for cleaning contaminants from and drying a ferrous metal surface without causing flash rusting on the surfaces comprising the steps of:

contacting said surface with a solvent selected from the group consisting of terpene hydrocarbon, alcohol, ether, amine, ester, orange terpene hydrocarbon, hydrotreated light petroleum distillate, aliphatic hydrocarbon, aliphatic ester, $C_{10}$ branched chain synthetic ester and aliphatic petroleum hydrocarbon;

heating and ultrasonically agitating said solvent to solubilize and dislodge contaminants from said surface;

rinsing said surface with a heated, ultrasonically agitated aqueous rinsing solution capable of protecting ferrous metal surfaces from flash rusting and comprising at least one water-soluble anionic pH modifier in an amount of about 0.00001 percent to about 50 percent by weight of said aqueous rinsing solution, wherein said aqueous rinsing solution has pH above 7, the pH modifier being selected from the group consisting of hydroxides, carbonate, bicarbonate, phosphates of metals in groups I and II elements, ammonia, ammonium water soluble primary amines, water soluble secondary amines, water soluble tertiary amines, and low molecular weight primary, secondary and tertiary alkyl, aryl or alkyl aryl, cyclic or acyclic amines or amine derivatives, with or without alkyloxylation, with or without termination, and derivatives and mixtures thereof, whereby said surface is rendered hydrophilic; and drying said surface.

2. A process as recited in claim 1 wherein the aqueous rinsing solution is agitated by means of mechanical agitation, vertical or horizontal oscillation, rotation, air spray, or pressurized submerged spray in addition to ultrasonic means.

3. A process as recited in claim 1 wherein the pH modifier of the aqueous rinsing solution is in an amount of about 0.0001 percent to about 10 percent by weight of said solution.

4. A process as recited in claim 1 wherein said cationic pH modifier has a molecular weight between 31 and 5000.

5. A process as recited in claim 1 wherein said aqueous rinsing solution comprises a basic aqueous rinsing solution of 2-aminoethanol.

6. A process as recited in claim 5 herein said aqueous rinsing solution has a pH of about 10 to 11.5.

7. A process as recited in claim 1 wherein said aqueous rinsing solution comprises a basic aqueous rinsing solution of neutralized C6-C30 fatty acids mixture, 2-aminoethanol, ethoxylated alkyl phosphate ester and ethoxylated alkyl amine guanidine complex and N-2-hydroxyethyl-2-aminoethanol.

8. A process as recited in claim 7 wherein said aqueous rinsing solution has a pH of about 9.

9. A process as recited in claim 1 wherein said aqueous rinsing solution comprises a basic aqueous rinsing solution of 2-aminoethanol and potassium hydroxide.

10. A process as recited in claim 9 wherein said aqueous rinsing solution has a pH of about 10–11.5.

11. A process for cleaning contaminants from and drying a ferrous metal surface without causing flash rusting on the surface comprising the steps of:

contacting said surface with a solvent selected from the group consisting of terpene hydrocarbon, alcohol, ether, amine, ester, orange terpene hydrocarbon, hydrotreated light petroleum distillate, aliphatic hydrocarbon, aliphatic ester, $C_{10}$ branched chain synthetic ester and aliphatic petroleum hydrocarbon;

heating and ultrasonically agitating said solvent to solubilize and dislodge contaminants from said surface;

displacing solvent residues from said surface with an aqueous displacement solution comprising an aqueous solution of at least one surfactant and a pH modifier by immersing, heating and ultrasonically agitating said surface in said aqueous displacement solution;

rinsing said surface with a heated, ultrasonically agitated aqueous rinsing solution capable of protecting ferrous metal surfaces from flash rusting and comprising at least one water-soluble anionic pH modifier in an amount of about 0.00001 percent to about 50 percent by weight of said aqueous rinsing solution, wherein said aqueous rinsing solution has pH above 7, the pH modifier being selected from the group consisting of hydroxides, carbonate, bicarbonate, phosphates of metals in groups I and II elements, ammonia, ammonium water soluble primary amines, water soluble secondary amines, water soluble tertiary amines, and low molecular weight primary, secondary and tertiary alkyl, aryl or alkyl aryl, cyclic or acyclic amines or amine derivatives, with or without alkyloxylation, with or without termination, and derivatives and mixtures thereof, whereby said surface is rendered hydrophilic; and drying said surface.

12. A process for removing a solvent from and drying a ferrous metal surface without causing flash rusting on the surface comprising the steps of:

heating and ultrasonically agitating said solvent;

rinsing said surface with a heated, ultrasonically agitated aqueous rinsing solution capable of protecting ferrous metal surfaces from flash rusting and comprising at least one water-soluble anionic or cationic pH modifier in an amount of about 0.00001 percent to about 50 percent by weight of said aqueous rinsing solution, wherein said aqueous rinsing solution has pH above 7, the pH modifier being selected from the group consisting of hydroxides, carbonate, bicarbonate, phosphates of metals in groups I and II elements, ammonia, ammonium water soluble primary amines, water soluble secondary amines, water soluble tertiary amines, and low molecular weight primary, secondary and tertiary alkyl, aryl or alkyl aryl, cyclic or acyclic amines or amine derivatives, with or without alkyloxylation, with or without termination, and derivatives and mixtures thereof, whereby said surface is rendered hydrophilic; and drying said surface.

* * * * *